US006029837A

United States Patent [19]

Slat et al.

[11] Patent Number: 6,029,837

[45] Date of Patent: Feb. 29, 2000

[54] PLASTIC BLOW MOLDED BOTTLE HAVING HAND GRIPS

[75] Inventors: William A. Slat, Brooklyn; Craig A. Larson, Howell, both of Mich.

[73] Assignee: Plastipak Packaging, Inc., Plymouth, Mich.

[21] Appl. No.: 09/167,767

[22] Filed: Oct. 7, 1998

[51] Int. Cl.[7] ..... B65D 45/24

[52] U.S. Cl. ..... 215/384; 215/382; 215/383

[58] Field of Search ..... 215/370, 383, 215/378, 379, 384, 382; 220/267, 615; D9/530, 536, 537, 538, 539, 541, 552, 557, 556, 565, 569, 543

[56] References Cited

U.S. PATENT DOCUMENTS

| | | | |
|---|---|---|---|
| D. 198,407 | 6/1964 | Busch | 215/384 |
| D. 199,868 | 12/1964 | Price et al. | D9/543 X |
| D. 201,470 | 6/1965 | Plattner | D9/543 X |
| D. 218,018 | 7/1970 | Lattraye | D9/543 |
| D. 382,485 | 8/1997 | Krishnakumar et al. . | |
| D. 383,067 | 9/1997 | Gower et al. . | |
| 4,300,612 | 11/1981 | Schroeder, Jr. et al. | 215/675 X |
| 5,103,988 | 4/1992 | Reil et al. | 215/384 |
| 5,392,937 | 2/1995 | Prevot et al. . | |
| 5,758,790 | 6/1998 | Ewing, Jr. | 215/384 |

*Primary Examiner*—Gary E. Elkins
*Assistant Examiner*—Tri M. Mai
*Attorney, Agent, or Firm*—Brooks & Kushman P.C.

[57] ABSTRACT

A plastic blow molded bottle (10) includes a pair of vertically extending hand grips (32) depressed inwardly at a rib reinforced shoulder (22) and at a body portion (16) of the bottle. Each hand grip (32) has a plurality of horizontally extending reinforcing ribs (34) that have curved shapes and are spaced vertically from each other.

8 Claims, 5 Drawing Sheets

28
30
26
10
22
24t
40
24
20
38
50
56
16
42
52
32
34
54
36
18
46
12
62
48
44
48

PLASTIC BLOW MOLDED BOTTLE HAVING HAND GRIPS

TECHNICAL FIELD

This invention relates to a plastic blow molded bottle having a pair of hand grips constructed to rigidify the bottle.

BACKGROUND ART

Plastic blow molded bottles having hand grips are disclosed by U.S. Pat. Nos. Des. 382,485 Krishnakumar et al.; Des. 383,067 Gower et al.; and 5,392,937 Prevot et al. These prior blow molded bottles have the hand grip located entirely within the bottle body portion that extends between a lower base and an upper dispensing end.

DISCLOSURE OF INVENTION

An object of the present invention is to provide an improved plastic blow molded bottle having hand grips and constructed to provide reinforcement of the bottle.

In carrying out the above object, a plastic blow molded bottle constructed in accordance with the present invention includes a lower base for supporting the bottle in an upstanding orientation. A body portion of the bottle has lower and upper ends with the lower end being closed by the lower base. A shoulder of the bottle extends inwardly and upwardly from the upper end of the body portion. The shoulder has reinforcing ribs that extend radially and have diverging shapes in an outward direction. A dispensing spout of the bottle extends upwardly from the shoulder and has an upper dispensing opening. A pair of spaced hand grips of the bottle extend vertically and are depressed inwardly at the shoulder and the body portion. Each hand grip has a plurality of horizontally extending reinforcing ribs of curved shapes spaced vertically from each other. Each hand grip has a lower end spaced above the lower base, and each hand grip has an upper end that is located at the shoulder whose adjacent reinforcing ribs are truncated from the other reinforcing ribs with the truncated ribs extending into immediate proximity with the upper end of the grip.

The construction of the plastic blow molded bottle with the pair of hand grips extending vertically at the shoulder and the body portion reinforces the bottle and also facilitates hot filling of the bottle by providing a strength that can accommodate for shrinkage after cooling of the hot filled contents. In the preferred construction of the plastic blow molded bottle, the reinforcing ribs of the shoulder have upper and lower curved ends. The lower end of the body portion preferably includes lower reinforcing ribs that most preferably have upper and lower curved ends.

The preferred construction of the plastic blow molded bottle also has lower and upper reinforcing ribs extending horizontally generally between the pair of hand grips.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
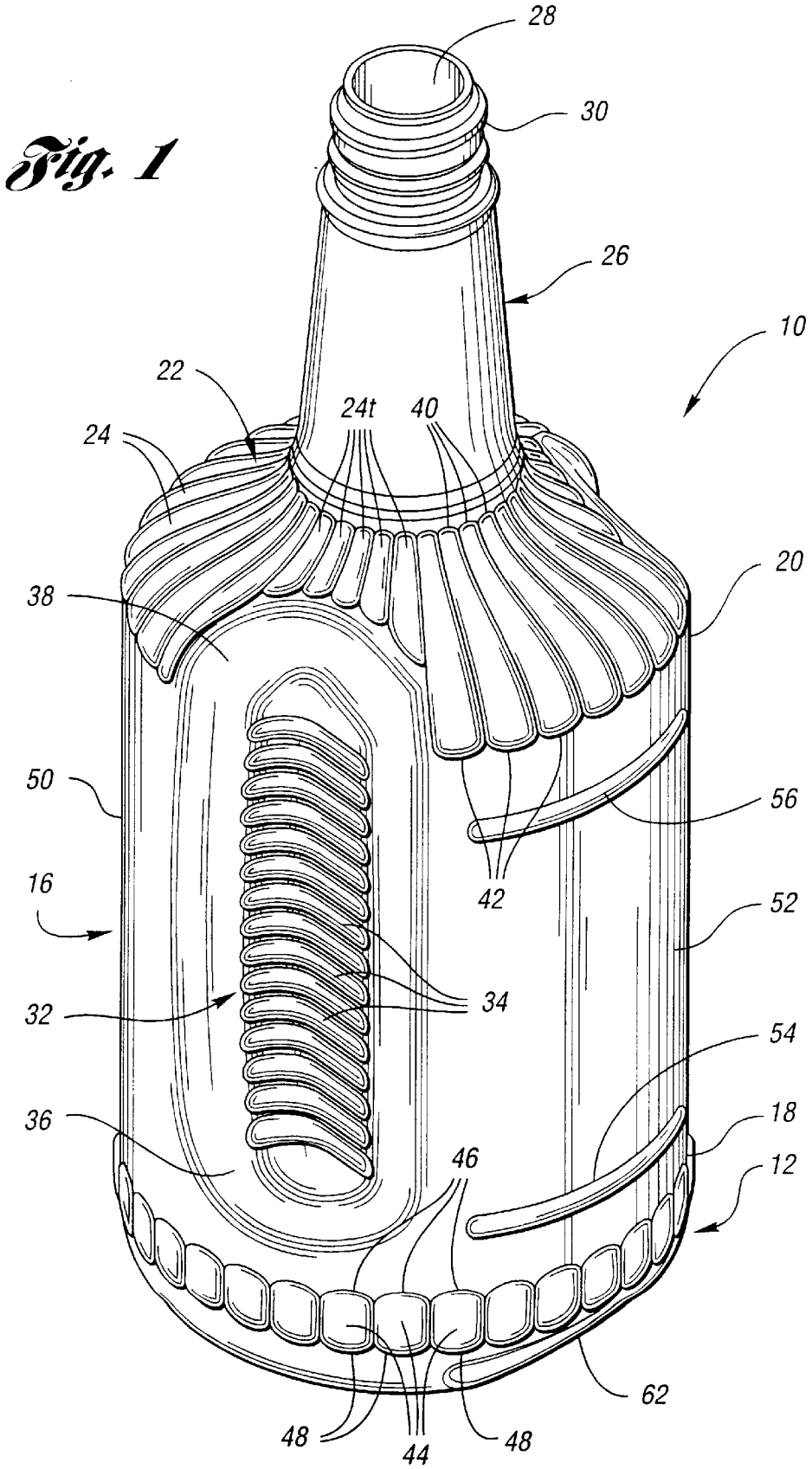
FIG. 1 is a perspective view looking downwardly at a plastic blow molded bottle constructed in accordance with the present invention.
Figure 2:
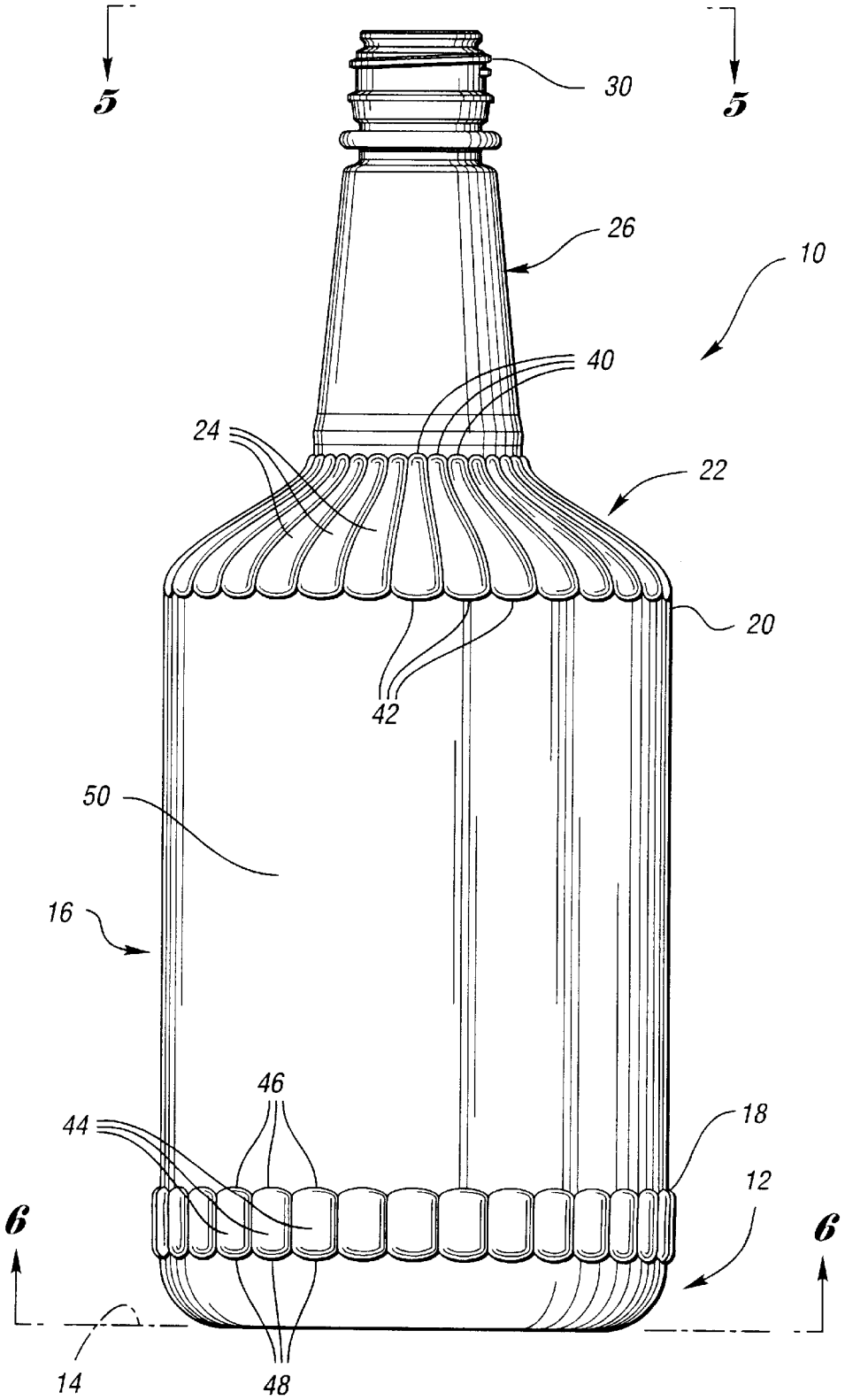
FIG. 2 is a front elevational view of the bottle.
Figure 3:
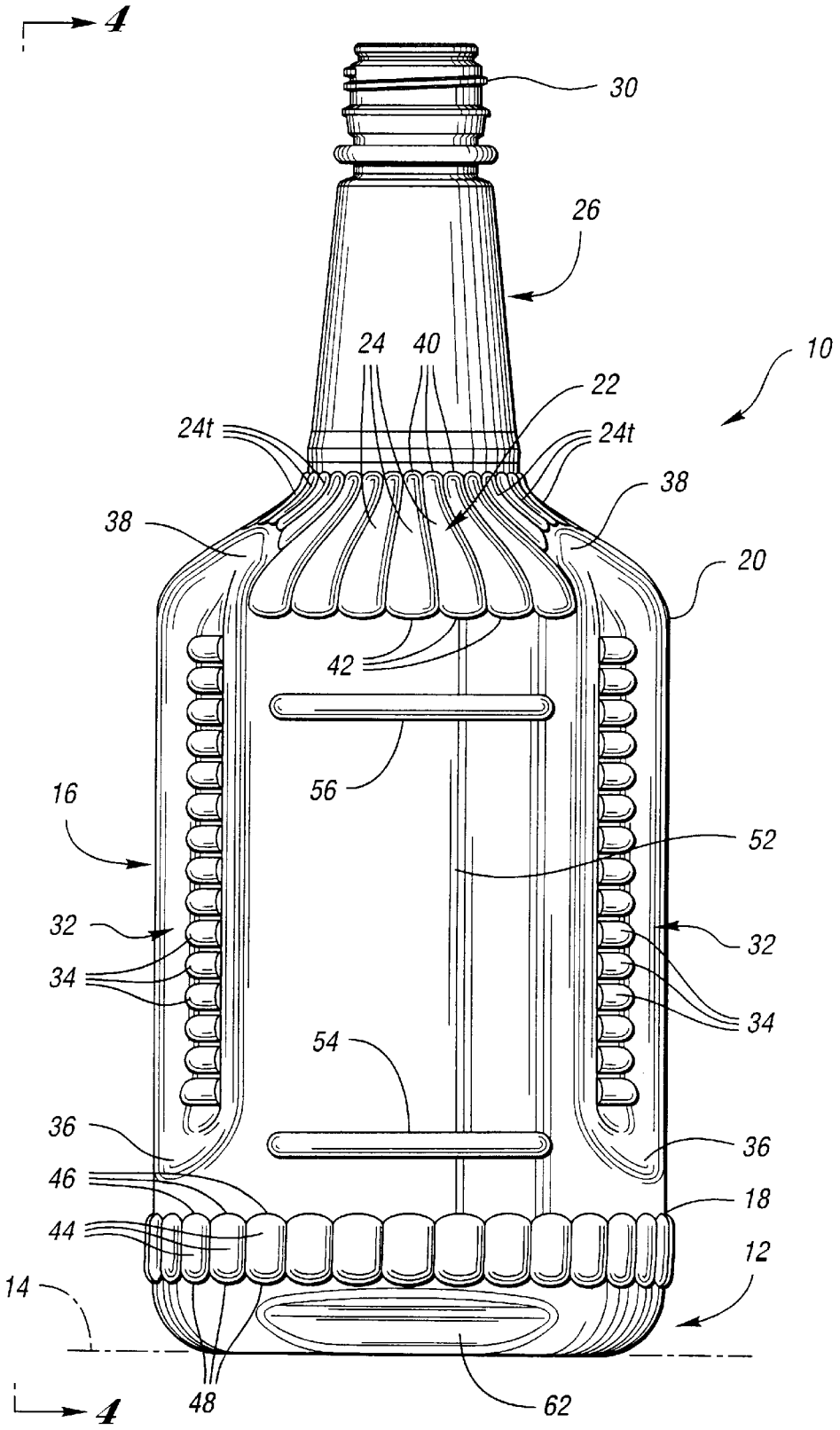
FIG. 3 is a rear elevational view of the bottle.
Figure 4:
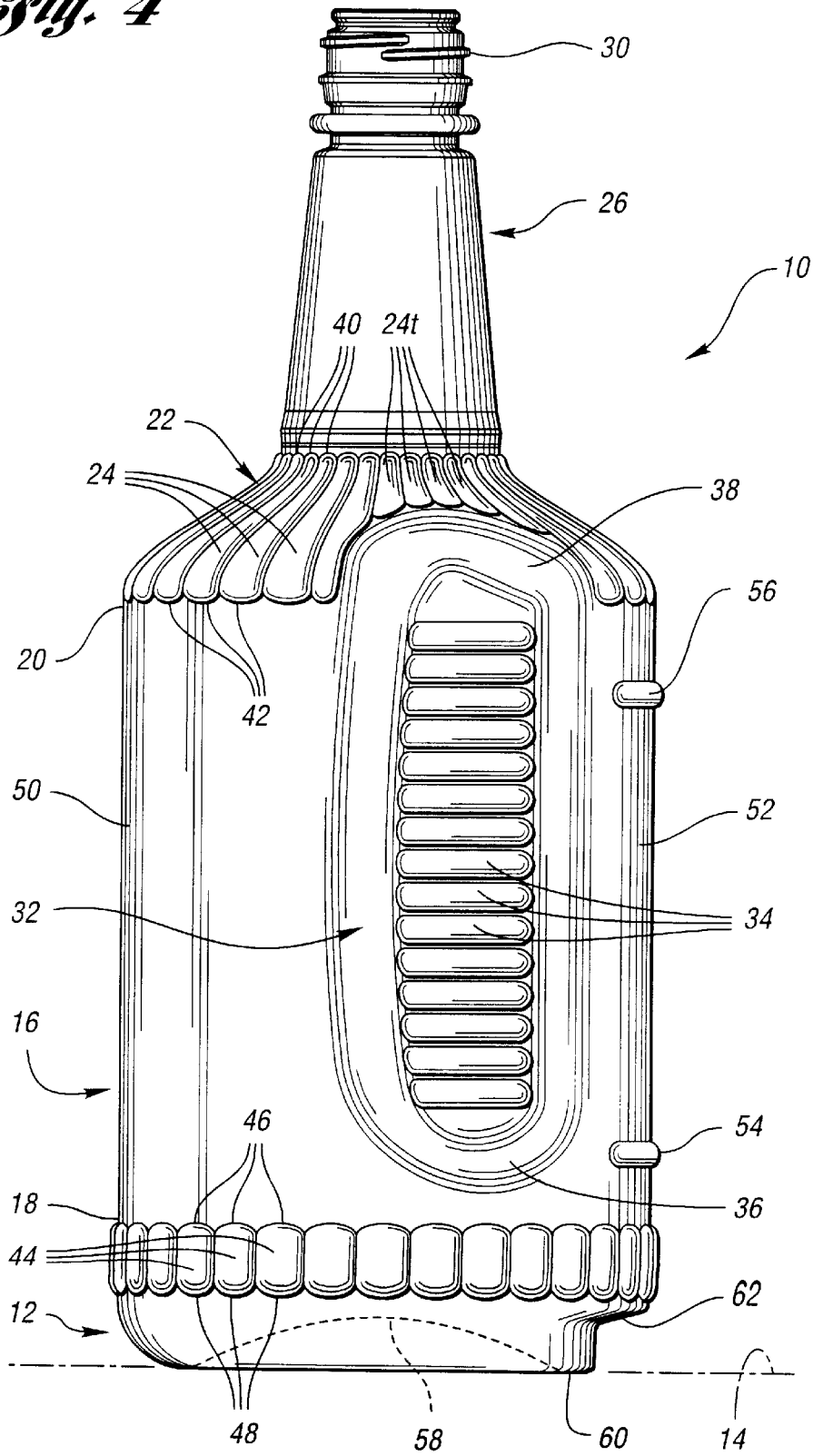
FIG. 4 is a side elevational view of the bottle taken along the direction of line 4—4 in FIG. 3.
Figure 5:
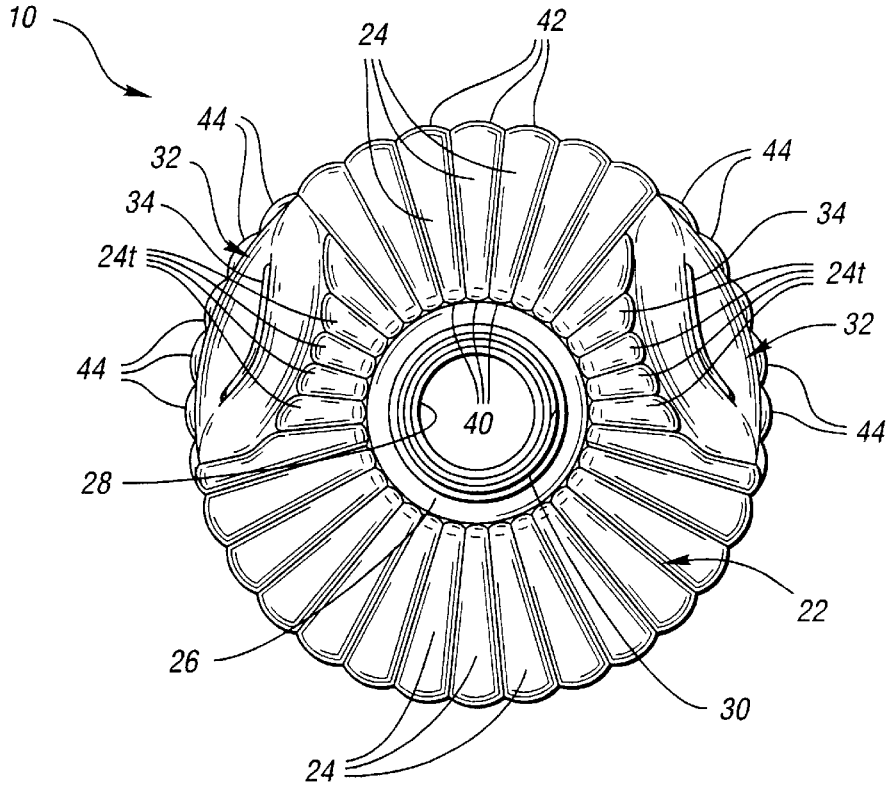
FIG. 5 is a top plan view of the bottle taken along the direction of line 5—5 in FIG. 2.

With reference to FIGS. 1–4, a plastic blow molded bottle constructed in accordance with the invention is generally indicated by 10 and is most preferably manufactured from polyethylene terephthalate by an injection stretch blow molding process. This bottle 10 includes a lower base 12 for supporting the bottle in an upstanding orientation on a lower support surface 14 as shown in FIGS. 2–4. A body portion 16 of the bottle has lower and upper ends 18 and 20 with the lower end being closed by the lower base 12.

With continuing reference to FIGS. 1–4, the bottle 10 has a shoulder 22 extending inwardly and upwardly from the upper end 20 of the body portion 16. This shoulder 22 has reinforcing ribs 24 that extend radially and have diverging shapes in an outward direction. A dispensing spout 26 of the bottle extends upwardly from the center of the shoulder 22 and has an upper dispensing opening 28 through which the bottle contents are filled and subsequently dispensed. A retainer in the form of a thread 30 provides for securement of an unshown closure cap.

With combined reference to FIGS. 1, 3, 4 and 5, the bottle 10 includes a pair of spaced hand grips generally indicated by 32. These hand grips extend vertically and are depressed inwardly at the shoulder 22 and at the body portion 16. Each hand grip 32 has a plurality of horizontally extending reinforcing ribs 34 of curved shapes spaced vertically from each other. Each of the hand grips 32 has a lower end 36 spaced above the lower base 12. In addition, each hand grip 32 has an upper end 38 that is located at the shoulder 22 whose adjacent reinforcing ribs 24t are truncated from the other reinforcing ribs 24 with the truncated ribs extending into immediate proximity with the upper end 38 of the grip.

The bottle 10 as described above provides a reinforced construction of the hand grips 32 by virtue of the location of their upper ends 38 at the shoulder 22. This construction also provides sufficient rigidity to permit hot filling due to the strength that can accommodate for shrinkage after cooling without excessive deformation of the bottle at the hand grips. More specifically, the construction of the reinforcing ribs 24 and the immediate proximity of the truncated reinforcing ribs 24*t* adjacent the upper ends 38 of the grips provide cooperation that strengthens the bottle.

In the preferred construction of the bottle 10, the lower and upper ends 36 and 38 of the hand grips 32 each have a curved shape as best shown in FIG. 1. Furthermore, the reinforcing ribs 24 of the shoulder 22 have upper and lower curved ends 40 and 42 with the upper ends located adjacent the lower extremity of the dispensing spout 26 and with the lower ends located adjacent the upper end 20 of the body portion 16.

As shown in FIGS. 1–4, the lower end 18 of the body portion 16 includes lower reinforcing ribs 44 around its circumference. These lower reinforcing ribs most preferably have upper and lower curved ends 46 and 48.

As illustrated in FIGS. 1–4, the bottle 10 also includes a front panel 50 that extends circumferentially for slightly less than 180° between the front extremities of the hand grips 32. A rear panel 52 of the bottle extends circumferentially for about 90° between the rear extremities of the hand grips 32 and has lower and upper reinforcing ribs 54 and 56 extending horizontally generally between the pair of hand grips adjacent the lower and upper ends 18 and 20 of the body portion 16. The reinforcing ribs 54 and 56 may also define a label area of the bottle.

Figure 6:
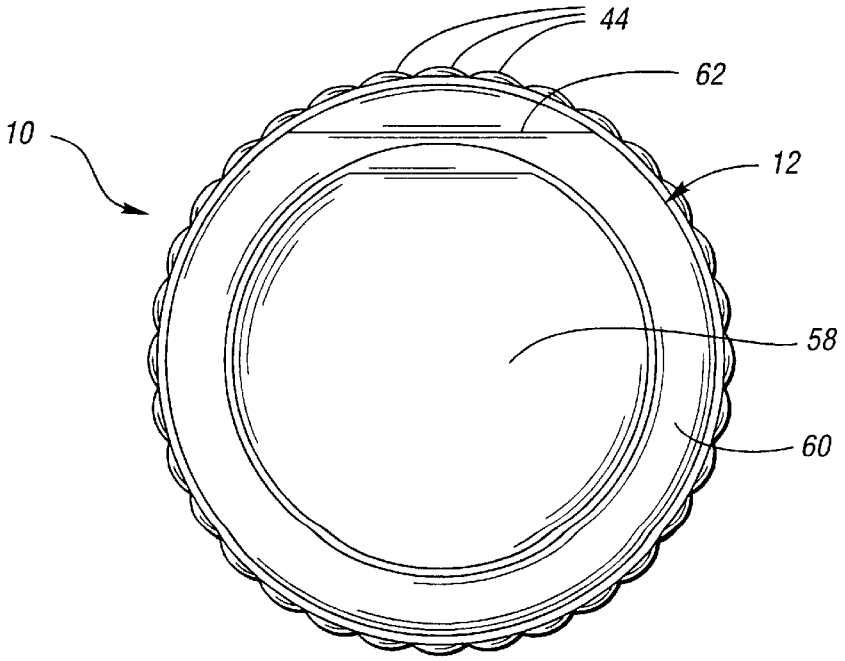
FIG. 6 is a bottom plan view of the bottle taken along the direction of line 6—6 in FIG. 2.

As shown in FIGS. 3 and 6, the lower base 12 has an upwardly extending center 58 surrounded by an annular support surface 60. Below the rear panel 52, the lower base 12 has an indexing depression 62 that partially interrupts the support surface 60.

While the best mode for carrying out the invention has been described in detail, those familiar with the art to which this invention relates will recognize various alternative designs and embodiments for practicing the invention as defined by the following claims.

What is claimed is:

1. A plastic blow molded bottle, comprising:

a lower base for supporting the bottle in an upstanding orientation;

a body portion having lower and upper ends with the lower end being closed by the lower base;

a shoulder extending inwardly and upwardly from the upper end of the body portion, and the shoulder having reinforcing ribs that extend radially and have diverging shapes in an outward direction;

a dispensing spout extending upwardly from the shoulder and having an upper dispensing opening; and a pair of spaced hand grips extending vertically and being depressed inwardly at the shoulder and the body portion, each hand grip having a plurality of horizontally extending reinforcing ribs of curved shapes spaced vertically from each other, each hand grip having a lower end spaced above the lower base, and each hand grip having an upper end that is located at the shoulder whose adjacent reinforcing ribs are truncated from the other reinforcing ribs with the truncated ribs extending into immediate proximity with the upper end of the grip.

2. A plastic blow molded bottle as in claim 1 wherein the lower and upper ends of the hand grips each have a curved shape.

3. A plastic blow molded bottle as in claim 1 wherein the reinforcing ribs of the shoulder have upper and lower curved ends.

4. A plastic blow molded bottle as in claim 1 wherein the lower end of the body portion includes lower reinforcing ribs.

5. A plastic blow molded bottle as in claim 4 wherein the lower reinforcing ribs have upper and lower curved ends.

6. A plastic blow molded bottle as in claim 1 further including lower and upper reinforcing ribs extending horizontally generally between the pair of hand grips.

7. A plastic blow molded bottle, comprising:

a lower base for supporting the bottle in an upstanding orientation;

a body portion having lower and upper ends with the lower end being closed by the lower base;

a shoulder extending inwardly and upwardly from the upper end of the body portion, the shoulder having reinforcing ribs that extend radially and have diverging shapes in an outward direction, and the reinforcing ribs of the shoulder having upper and lower curved ends;

a dispensing spout extending upwardly from the shoulder and having an upper dispensing opening; and a pair of spaced hand grips extending vertically and being depressed inwardly at the shoulder and the body portion, each hand grip having a plurality of horizontally extending reinforcing ribs of curved shapes spaced vertically from each other, each hand grip having a curved lower end spaced above the lower base, and each hand grip having a curved upper end that is located at the shoulder whose adjacent reinforcing ribs are truncated from the other reinforcing ribs with the truncated ribs extending into immediate proximity with the upper end of the grip.

8. A plastic blow molded bottle, comprising:

a lower base for supporting the bottle in an upstanding orientation;

a body portion having lower and upper ends with the lower end being closed by the lower base, and the lower end of the body portion including reinforcing ribs having upper and lower curved ends;

a shoulder extending inwardly and upwardly from the upper end of the body portion, and the shoulder having reinforcing ribs that extend radially and have diverging shapes in an outward direction, and the reinforcing ribs of the shoulder having upper and lower curved ends;

a dispensing spout extending upwardly from the shoulder and having an upper dispensing opening; and a pair of spaced hand grips extending vertically and being depressed inwardly at the shoulder and the body portion, each hand grip having a plurality of horizontally extending reinforcing ribs of curved shapes spaced vertically from each other, each hand grip having a curved lower end spaced above the lower base, and each hand grip having a curved upper end that is located at the shoulder whose adjacent reinforcing ribs are truncated from the other reinforcing ribs with the truncated ribs extending into immediate proximity with the upper end of the grip.

* * * * *